United States Patent [19]

Locati

[11] Patent Number: 4,685,761

[45] Date of Patent: Aug. 11, 1987

[54] ELECTRICAL CONTACT ASSEMBLY AND METHOD OF ASSEMBLY

[75] Inventor: Ronald P. Locati, Harrisburg, Pa.

[73] Assignee: AMP Incorporated, Harrisburg, Pa.

[21] Appl. No.: 827,474

[22] Filed: Feb. 5, 1986

Related U.S. Application Data

[63] Continuation of Ser. No. 665,597, Oct. 29, 1984, abandoned, which is a continuation of Ser. No. 364,153, Mar. 31, 1982, abandoned.

[51] Int. Cl.[4] ..... H01R 11/22

[52] U.S. Cl. ..... 439/843; 29/876; 439/886; 439/879

[58] Field of Search ..... 339/258 R, 258 D, 258 C, 339/258 RR, 262 R, 262 RR, 276 R, 276 T, 278 C; 29/876, 881

[56] References Cited

U.S. PATENT DOCUMENTS

| | | | |
|---|---|---|---|
| 2,907,976 | 10/1959 | Damon . | |
| 3,296,577 | 1/1967 | Travis et al. | 339/258 R |
| 3,564,487 | 2/1971 | Upstone et al. . | |
| 3,685,000 | 8/1972 | Robbins | 339/14 P |
| 4,120,556 | 10/1978 | Waldron et al. | 339/276 T |
| 4,184,736 | 1/1980 | Spaulding | 339/258 R |
| 4,373,773 | 2/1983 | Piscitelli et al. | 339/258 R |
| 4,434,552 | 3/1984 | Brush, Sr. et al. | 29/876 |
| 4,563,055 | 1/1986 | Hemmer | 339/258 R |
| 4,566,752 | 1/1986 | Hemmer | 339/258 R |

FOREIGN PATENT DOCUMENTS

| | | |
|---|---|---|
| 705639 | 3/1968 | Belgium . |
| A2103433 | 2/1983 | United Kingdom . |

OTHER PUBLICATIONS

Cinch Mfg Co, Schematic Drawing of Cinch Selective Plating Process, pp. 1–4, Aug. 1965, Chicago, Il.

N. L. Brown, Bonded Gold Fingers as a Low Cost Alternative to Patterned Edgeboard Fingers for General PWB Use, pp. 121–128, Apr. 1978, Bell Labs, Denver, Col.

*Primary Examiner*—Gil Weidenfeld
*Assistant Examiner*—Paula A. Austin
*Attorney, Agent, or Firm*—Adrian J. LaRue; Anton P. Ness

[57] ABSTRACT

An electrical contact assembly comprises a wire barrel onto which an electrical conductor is connected along with a receptacle contact member covered by a stamped and formed hood member. A C-shaped section of the receptacle is frictionally secured in a bore of the wire barrel with the hood member surrounding the receptacle and being crimped onto the wire barrel. The hood has a beveled lead-in entrance to facilitate insertion of a pin contact member into electrical connection with the receptacle contact member at a substantially low insertion force.

18 Claims, 7 Drawing Figures

ELECTRICAL CONTACT ASSEMBLY AND METHOD OF ASSEMBLY

REFERENCE TO RELATED APPLICATIONS

This is a continuation of application Ser. No. 665,597 filed Oct. 29, 1984, now abandoned, which is a continuation of application Ser. No. 364,153, filed Mar. 31, 1982, now abandoned.

FIELD OF THE INVENTION

This invention relates to electrical connectors and more particularly to an electrical contact assembly for use in electrical connectors.

BACKGROUND OF THE INVENTION

A known type of electrical contacts are those that are formed as screw machine parts from bar stock. The bar stock from which these electrical contacts are machined has to be hard enough to enable them to be subject to screw machine operations which can present problems when electrical conductors are crimped thereto due to the wire barrels breaking. These entire contacts are evenly gold plated thereover because they cannot be selectively gold plated. The insertion force when a pin is inserted thereinto is quite high.

Another type of known electrical contact assembly includes a screw machine wire barrel onto which is crimped a telescoped receptacle and hood. This type of contact can be selectively plated but a major drawback is aligning the receptacle and hood and simultaneously crimping them onto the wire barrel as properly aligned and concentric members. The wire barrel is a screw machine part and, due to its configuration, cannot be readily cold formed. The wire barrel would also be subject to breakage when crimped onto an electrical conductor because of the hardness of the metal if not subjected to annealing. The insertion force is not believed to be too low. Crimping of the receptacle onto the wire barrel does not provide a good mechanical and electrical connection and limits the diameter of the receptacle. The hood contains no beveled lead-in surface for the pin.

SUMMARY OF THE INVENTION

According to the present invention, an electrical contact assembly comprises a wire barrel onto which an electrical conductor is connected along with a stamped and formed receptacle contact member covered by a hood member. A C-shaped section of the receptacle is frictionally secured in a bore of the wire barrel with the hood member surrounding the receptacle and being crimped onto the wire barrel. The hood has a beveled lead-in entrance to facilitate insertion of a pin contact member into electrical connection with the receptacle contact member at a substantially low insertion force.

DETAILED DESCRIPTION OF A PREFERRED EMBODIMENT

Figures 1, 2:
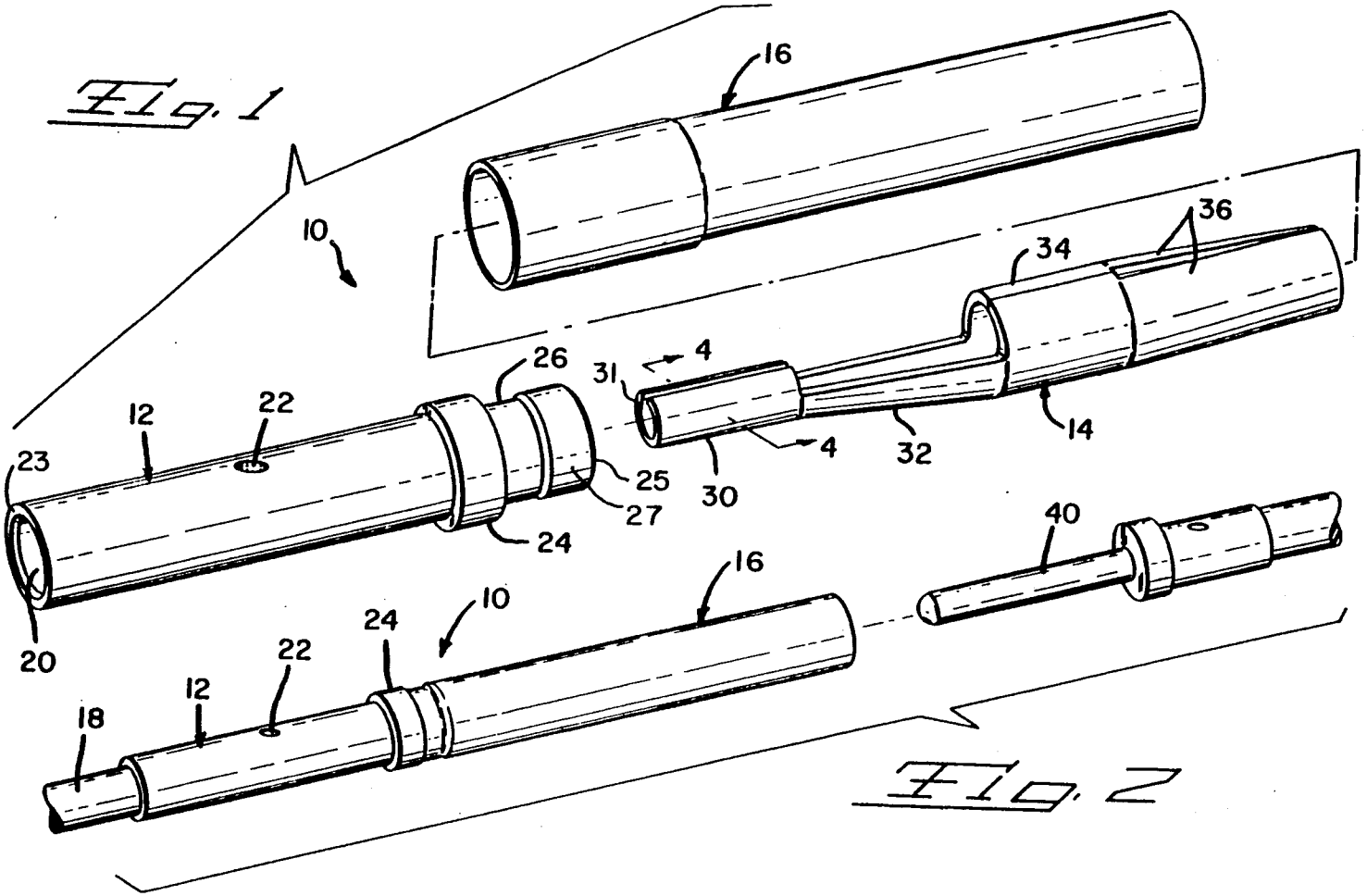
FIG. 1 is a perspective and exploded view of an electrical contact assembly.
FIG. 2 is a perspective view of an assembled electrical contact assembly with an electrical pin contact exploded therefrom.
Figures 3, 4, 5, 6, 7:
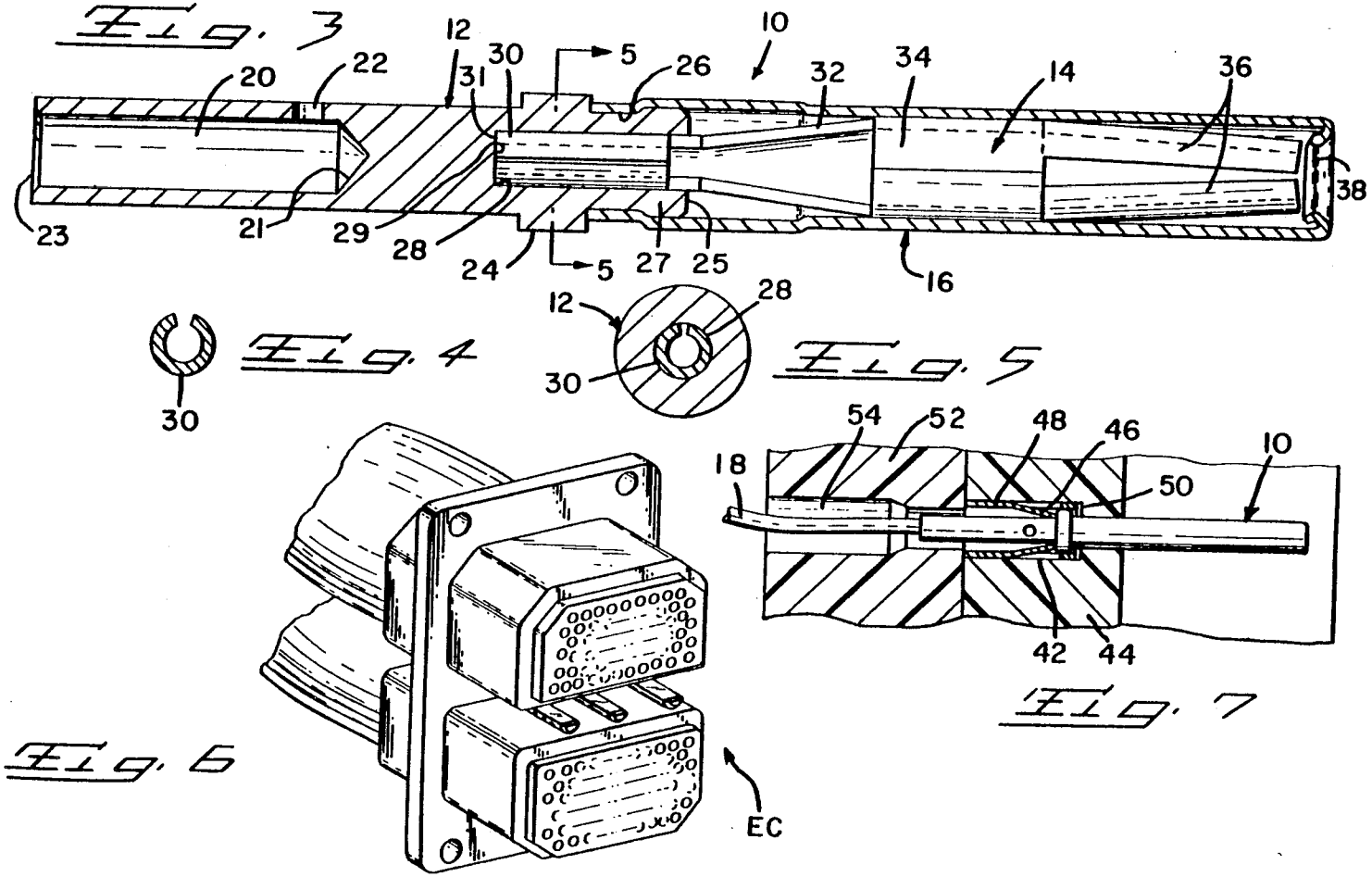
FIG. 3 is a part longitudinal section view of the assembled electrical contact assembly.
FIG. 4 is a cross-sectional view taken along line 4—4 of FIG. 1.
FIG. 5 is a cross-sectional view taken along line 5—5 of FIG. 3.
FIG. 6 is a perspective view showing an electrical connector in which the electrical contact assemblies are mounted.
FIG. 7 is a part longitudinal section view showing the electrical contact assembly secured in an opening of the electrical connector.

FIGS. 1 through 5 illustrate the electrical contact assembly 10 of the present invention with FIG. 6 showing an electrical connector EC in which the electrical contact assemblies are secured for matable connection with a simlilar electrical connector (not shown). Electrical contact assembly 10 includes a wire barrel 12, a receptacle contact member 14, and a hood member 16.

Wire barrel 12 can be a screw machine part or it can be made in accordance with cold-forming techniques in accordance with conventional practices, and is therefore seamless having a continuous circumference therearound. If wire barrel 12 is made as a screw machine part, copper alloy material is used, whereas if it is formed in accordance with cold-forming techniques, soft copper is used. It is preferable that soft copper be used so that wire barrel 12 can be cold-formed and it can be readily crimped onto electrical conductor 18.

Wire barrel 12 is provided with a bore 20 extending inwardly from rearward end 23 in which electrical conductor 18 is disposed for electrical connection therewith, bore 20 having a rearwardly facing stop surface 21 at a forward end thereof. A sight hole 22 is located in wire barrel 12 to make certain that electrical conductor 18 has been properly positioned within bore 20 prior to it being connected thereto. An annular shoulder 24 is located adjacent the front end 25 of wire barrel 12 next to annular recess 26. A bore 28 extends inwardly from the front end 25 of wire barrel 12 within forward section 27 thereof and has a forwardly facing stop surface 29 therealong spaced rearwardly from front end 25 and forwardly of stop surface 21 of bore 20.

Receptacle contact member 14 is a stamped and formed member that is preferably stamped from beryllium copper and includes a C-shaped section 30. As shown in FIGS. 4 and 5, when formed C-shaped section 30 has an outer surface diameter larger than the inside diameter of bore 28, and when inserted into bore 28, C-shaped section 30 which frictionally engages bore 28 with rearward end 31 thereof against stop surface 29 of wire barrel 12 forms an excellent mechanical and electrical connection therewith thereby securing contact member 14 therewithin. The resilient characteristics of C-shaped section 30 adds to the retention characteristics of C-shaped section 30 in bore 28. Tapered channel-shaped section 32 extends between C-shaped section 30 and cylindrical section 34. Receptacle contact member 14 has arcuate-shaped contact-engaging members 36 extending outwardly from cylindrical section 34 which taper towards each other toward the front ends thereof. Contact member 14 is selectively plated in the electrical contact area only on the inside surfaces of contact-engaging members 36 with a heavy gold plating, and the rest of the contact member is flash plated. The selective gold plating can be done on the material before stamping and forming of contact member 14 takes place.

Hood member 16 is a stainless steel cylindrical member which has its inner end crimped into annular recess 26, whereas its front end has a beveled surface 38 for facilitating insertion of pin contact member 40 into electrical contact with receptacle contact member 14. Hood member 16 protects contact member 14 and prevents spring contact-engaging members 36 from being overstressed.

The electrical contact assembly of the present invention has a low insertion force because receptacle contact member 14 is a stamped and formed part. This is a significant factor when a large number of receptacle contact members are to be electrically connected with pin contact members. Another important factor is the saving that takes place on selective gold plating because only heavy gold plating takes place on the internal surfaces of contact-engaging members 36 whereas the rest of contact member 14 and wire barrel 12 are flash plated.

FIG. 7 illustrates electrical contact assembly 10 secured in a passageway 42 in dielectric mounting block 44 of electrical connector EC by means of lances 46 of clip member 48 engaging shoulder 24 to prevent withdrawal of contact assembly 10. Shoulder 24 is limited in its inner movement within passageway 42 by stop surface 50 interposed between the larger and smaller diameter sections of passageway 42. Another dielectric block 52 abuts against block 44 and has a passageway 54 extending therethrough and in which part of the wire barrel of the contact assembly is disposed and along which part of electrical conductor 18 extends; the diameter of passageway 54 at the intersection between passageways 42 and 54 is smaller in diameter than passageway 42 to maintain clip member 44 in passageway 42. An epoxy material or the like can be placed in passageway 54 to seal the wire barrel and its termination to conductor 18.

I claim:

1. An electrical contact assembly of the type including a wire barrel member to which an electrical conductor means is to be connected and a telescoped receptacle contact member and hood member secured onto the wire barrel member, characterized in that:

said wire barrel member includes a rearard conductor-receiving section in which electrical conductor means is to be connected, and further includes a bore means extending inwardly from a front end of said wire barrel member, said bore means having a continuous circumference therearound and further having a forwardly facing stop surface means therewithin spaced rearwardly from the front end thereof and located forwardly of said conductor-receiving section;

said receptacle contact member is stamped and formed of metal and has a receptacle contact section and a securing section frictionally secured in said bore means in said wire barrel member, with the rearward end thereof disposed forwardly of and against said forwardly facing stop surface means; and said hood member has an inner end secured onto said wire barrel member and extends forwardly therefrom covering said receptacle contact section.

2. An electrical contact assembly as set forth in claim 1 characterized in that said securing section is C-shaped and formed to have an outer surface diameter larger than the inside diameter of said bore means.

3. An electrical contact assembly as set forth in claim 1 characterized in that said wire barrel member is formed as a screw machine member of a cold-formed member and said bore means is a blind bore means.

4. An electrical contact assembly as set forth in claim 1 characterized in that a front end of said hood member has tapered lead-in surface means facilitating movement of the electrical pin means into electrical connection with said receptacle contact member.

5. An electrical contact assembly as set forth in claim 1 characterized in that said receptacle contact member includes tapered channel-shaped means extending outwardly from said securing section and merging into a cylindrical section means, arcuate-shaped contact-engaging means extending outwardly from said cylindrical section means and tapering inwardly from said cylindrical section means to outer ends thereof.

6. An electrical contact assembly as set forth in claim 5 characterized in that inside surfaces of said contact-engaging means are coated heavily with gold while the outside surface of said contact-engaging means, said cylindrical section means, said channel-shaped means and said wire barrel member are coated very lightly with gold.

7. An electrical contact assembly comprising:

wire barrel means including a rearward conductor-receiving section in which electrical conductor means is to be connected, and bore means extending inwardly from a front end of said wire barrel means having a continuous circumference therearound and having a forwardly facing stop surface means therewithin spaced rearwardly from the front end thereof and located forwardly of said conductor-receiving section; and electrical contact means stamped and formed of metal and having securing-section means and contact section means, said securing-section means being frictionally disposed in said bore means with the rearward end thereof disposed forwardly of and against said forwardly facing stop surface means thereof, thereby mechanically securing said securing-section means in said bore means in electrical engagement therewith, said contact section means extending outwardly from said securing-section means for electrical connection with a matable electrical contact means.

8. An electrical contact assembly as set forth in claim 7 wherein said securing-section is C-shaped and formed to have an ouer surface diameter larger than the inside diameter of said bore means.

9. An electrical contact assembly as set forth in claim 7 wherein said wire barrel means is formed as a screw machine member or a cold-formed member and said bore means is a blind bore means.

10. An electrical contact assembly as set forth in claim 7 wherein said wire barrel means include shoulder means extending outwardly from a front end of said wire barrel means adjacent said front end, said shoulder means being circumferentially continuous and capable of being stoppingly engageable by a stop surface of a housing passageway and by lances of a clip member, securing the contact assembly in the housing.

11. An electrical contact assembly as set forth in claim 10 wherein said electrical contact means is a receptacle contact and a hood means telescopically extends over and along said receptacle contact and has an inner end secured onto said front end of said wire barrel means in abutting engagement with said shoulder means.

12. An electrical contact assembly of the type including a wire barrel member to which an electrical conductor means is to be connected and a telescoped receptacle contact member and hood member secured onto the wire barrel member charcterized in that:

said wire barrel member is formed as a screw machine member or a cold-formed member and has a rearward conductor-receiving section in which electrical conductor means is to be connected, blind bore means extending inwardly from a front end of said wire barrel member, and shoulder means extending outwardly from an external surface of said wire barrel member adjacent said front end;

said receptacle contact member is stamped and formed of metal and has a receptacle contact section and a securing section frictionally secured in said bore means in said wire barrel member; and said hood member has an inner end secured onto said wire barrel member and extends forwardly therefrom covering said receptacle contact section.

13. An electrical contact assembly as set forth in claim 12, further characterized in that said securing section is C-shaped and formed to have an outer surface diameter larger than the inside diameter of said blind bore means.

14. An electrical contact assembly comprising:

wire barrel means being formed as a screw machine member of cold-formed member and having a rearward conductor-receiving section in which electrical conductor means is to be connected, said conductor-receiving section being crimpable to said electrical conductor means, and blind bore means extending inwardly from a front end of said wire barrel means; and electrical contact means stamped and formed of metal and having securing-section means and contact section means, said securing-section means being frictionally disposed in said bore means thereby mechanically securing said securing-section means in said bore means in electrical engagement therewith, said contact section means extending outwardly from said securing-section means for electrical connection with a matable electrical contact means.

15. An electrical contact assembly as set forth in claim 14 wherein said securing-section means is C-shaped and formed to have an outer surface diameter larger than the inside diameter of said blind bore means.

16. A method of assembling an electrical contact assembly comprising the steps of:

selecting a wire barrel means having a rearward conductor-receiving section and a forward section having a continuous circumference therearound, and including a bore means extending thereinto from a front end thereof having a stop surface means therewithin spaced rearwardly from the front end thereof;

selecting a stamped and formed electrical contact means including a securing-section means at a rearward end thereof, said securing-section means having an outer diameter greater than the inner diameter of said bore means; and inserting said securing-section means into said bore means with the rearward end thereof against said stop surface means and frictionally disposing said securing-section means in said bore means.

17. A method as set forth in claim 16 wherein said wire barrel means is formed as a screw machine member or a cold-formed member and said bore means is a blind bore means.

18. A method as set forth in claim 16 further comprising the step of securing an inner end of a hood member to said electrical contact assembly to cover a contact section of said electrical contact means where said electrical contact means is a receptacle contact.

* * * * *